US006672860B2

(12) United States Patent
Bachinski et al.

(10) Patent No.: US 6,672,860 B2
(45) Date of Patent: Jan. 6, 2004

(54) PROXIMITY WARNING SYSTEM FOR A FIREPLACE

(75) Inventors: Thomas J. Bachinski, Lakeville, MN (US); David J. Oja, Burnsville, MN (US)

(73) Assignee: HON Technology Inc., Muscatine, IA (US)

( * ) Notice: Subject to any disclaimer, the term of this patent is extended or adjusted under 35 U.S.C. 154(b) by 0 days.

(21) Appl. No.: 10/120,890

(22) Filed: Apr. 10, 2002

(65) Prior Publication Data

US 2003/0192531 A1 Oct. 16, 2003

(51) Int. Cl.[7] ..... F23D 5/12; F23D 11/36
(52) U.S. Cl. ..... 431/13; 431/18; 431/153
(58) Field of Search ..... 431/13, 18, 153; 340/541, 545.3, 545.4

(56) References Cited

U.S. PATENT DOCUMENTS 4,797,657 A * 1/1989 Vorzimmer et al. ..... 340/541
4,897,630 A 1/1990 Nykerk
5,173,881 A 12/1992 Sindle
5,552,767 A 9/1996 Toman
5,555,876 A * 9/1996 Francisco et al. ..... 126/504
5,825,304 A 10/1998 Marin
6,114,950 A 9/2000 Schaible et al.
6,150,956 A 11/2000 Laufer
6,157,891 A 12/2000 Lin
6,276,407 B1 8/2001 Corfitsen
6,462,663 B1 * 10/2002 Wilson et al. ..... 340/573.1

OTHER PUBLICATIONS

McCarthy, Electronic fire guard, Derwent, IE 80484B3, Aug. 12, 1998, see entire document.*

* cited by examiner

*Primary Examiner*—Alfred Basichas
(74) *Attorney, Agent, or Firm*—Merchant & Gould P.C.

(57) ABSTRACT

A proximity warning system for a fireplace including a monitor module and an alarm module. The monitor module is configured to sense when an object, such as a person, enters a defined zone proximate to the fireplace. The monitor module may use a variety of techniques to sense when an object enters the defined zone. For example, the monitor module may use capacitance or pulse infrared light to detect when an object enters the defined zone. The alarm module is coupled to the monitor module to generate an alarm when the monitor module senses that the object has entered the defined zone. The alarm may be audible or visual.

19 Claims, 7 Drawing Sheets

PROXIMITY WARNING SYSTEM FOR A FIREPLACE

TECHNICAL FIELD

The present invention relates to fireplaces. More particularly, the invention relates to a proximity warning system for a fireplace.

BACKGROUND

Fireplaces have become increasingly commonplace in homes, businesses, and other buildings. A fireplace provides benefits including the generation of heat as well as an aesthetically-pleasing arrangement of flames, sounds, and smells. A fireplaces is typically mounted in a wall of a structure and may include one or more doors that allow access to an interior area of the fireplace where combustion occurs for activities such as, for example, providing combustible material and lighting a fire, if the fireplace is a wood-burning fireplace, or for lighting the pilot and starting the flames, if the fireplace is a gas fireplace.

However, such access to the fireplace can create safety issues. For example, a person accessing the interior of the fireplace can be burned or otherwise injured by the flames. In addition, because the fireplace produces heat, it is possible for one or more exterior surfaces of the fireplace to become heated. These exterior surfaces of the fireplace also pose a risk of burns to individuals or damage to objects that come into contact with the surfaces. Current fireplace designs fail to provide a system or method to monitor an area surrounding a fireplace and to initiate an alarm when an individual or object enters an area proximate the fireplace that may be unsafe.

Thus, there is a need for a warning system that can generate an alarm when an object approaches a fireplace.

SUMMARY

Generally, the present invention relates to fireplaces. More particularly, the invention relates to a proximity warning system for a fireplace.

In one aspect, the invention relates to a proximity warning system for a fireplace including a monitor module coupled to the fireplace, wherein the monitor module is configured to sense when an object enters a defined zone proximate to the fireplace, and an alarm module coupled to the monitor module to generate an alarm when the monitor module senses that the object has entered the defined zone.

In another aspect, the invention relates to a fireplace including a proximity warning system, the fireplace including an enclosure defining a combustion chamber and including at least one exposed surface, a plate coupled to the at least one exposed surface, wherein the plate includes a conductive area forming a first capacitor, a capacitance module, wherein the capacitance module is electrically coupled to the conductive area and includes a second capacitor that is tunable to match a capacitance of the first capacitor, and an alarm module electrically coupled to the capacitance module to generate an alarm when an object enters a defined zone proximate the fireplace and thereby cause the capacitance of the first capacitor to vary with respect to a capacitance of the second capacitor.

In yet another aspect, the invention relates to a fireplace including a proximity warning system, the fireplace including an enclosure defining a combustion chamber and including at least one exposed surface, an infrared light module for transmitting infrared light, a receiver module configured to receive reflected infrared light, and an alarm module coupled to the receiver module to generate an alarm when an object enters a defined zone proximate the fireplace and thereby causes the infrared light to reflect to the receiver module.

In another aspect, the invention relates to a proximity warning system for a fireplace including a means for sensing when an object enters a defined zone proximate to the fireplace, and a means for alarming when the object enters the defined zone.

In yet another aspect, the invention relates to a method for warning when an object approaches a fireplace, the method comprising steps of: providing a monitor module for monitoring when an object enters a defined zone proximate the fireplace; providing an alarm module coupled to the monitor module for generating an alarm when the object enters the defined zone; monitoring the defined zone; and generating an alarm when the object enters the defined zone.

The above summary of the present invention is not intended to describe each disclosed embodiment or every implementation of the present invention. Figures in the detailed description that follow more particularly exemplify embodiments of the invention. While certain embodiments will be illustrated and describing embodiments of the invention, the invention is not limited to use in such embodiments.

BRIEF DESCRIPTION OF THE DRAWINGS

The invention may be more completely understood in consideration of the following detailed description of various embodiments of the invention in connection with the accompanying drawings, in which.

While the invention is amenable to various modifications and alterant forms, specifics thereof have been shown by way of example and the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

The invention is applicable to fireplaces. More particularly, the invention relates to a proximity warning system for a fireplace. While the present invention is not so limited, an appreciation of the various aspects of the invention will be gained through a discussion of the examples provided below.

An example proximity warning system made in accordance with this invention may generally function to monitor a defined zone proximate a fireplace and generate an alarm when an object enters the defined zone. As used herein, the term "defined zone" indicates any area that is proximate to, or near, any portion of a fireplace that is exposed or accessible. The defined zone may increase or decrease in size depending on design characteristics and user requirements. The term "alarm" is used herein to denote any method of indicating when an object enters the defined zone, such as, for example, an audible alarm or a visual alarm. The term "object" as used herein denotes any physical object that may enter the defined zone proximate the fireplace. For example, the term "object" may include a person or other animal or may include inanimate objects as well.

I. First Example Embodiment

Figure 1:
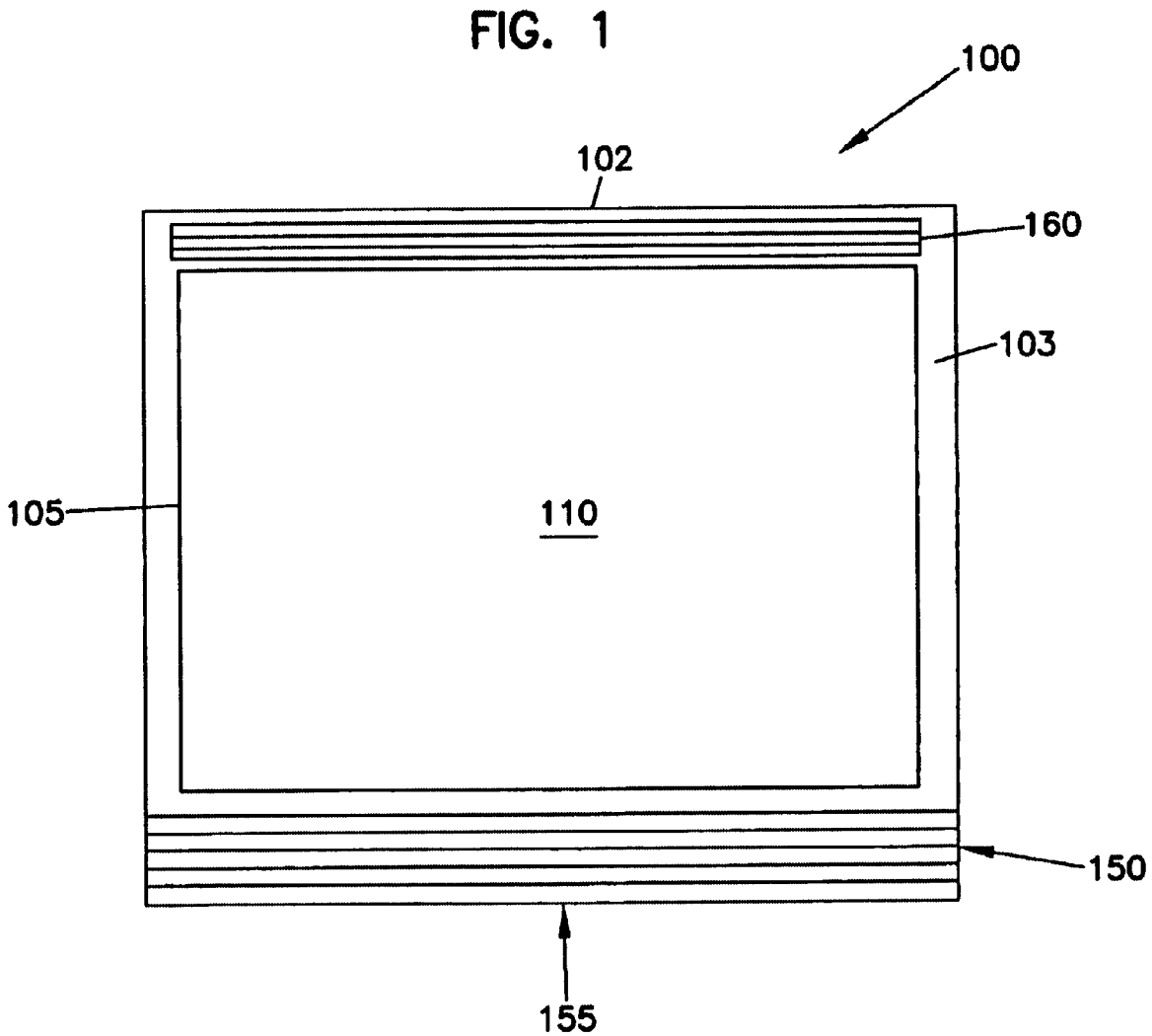
FIG. 1 is a front view of an example fireplace including a first example embodiment of a proximity warning system made in accordance with the present invention.

Referring now to FIG. 1, an example fireplace 100 is illustrated including an outer enclosure 102, a front panel 103, grills 150 and 160, and a combustion chamber enclosure 105 defining a combustion chamber 110. Fireplace 100 may be any type of fireplace, such as, for example, a wood-burning or gas fireplace. The combustion chamber 110 may be enclosed with a panel or one or more doors, or may be open as shown. The grills 150 and 160 may cover air intakes or air exhausts.

Fireplace 100 is provided as an example only, and any other known configuration for a fireplace may also be used. For example, the present invention may be used in conjunction with any prefabricated gas fireplace such as, for example, a direct vent, a universal vent, a B-vent, a horizontal/vertical-vent, a dual direct vent, a multisided unit having two or three glass panels as combustion chamber side panels, or in any fireplace unit, stove, or insert that requires a burner. Further, the invention may be utilized in any configuration of a solid-fuel burning fireplace as well.

Figure 2:
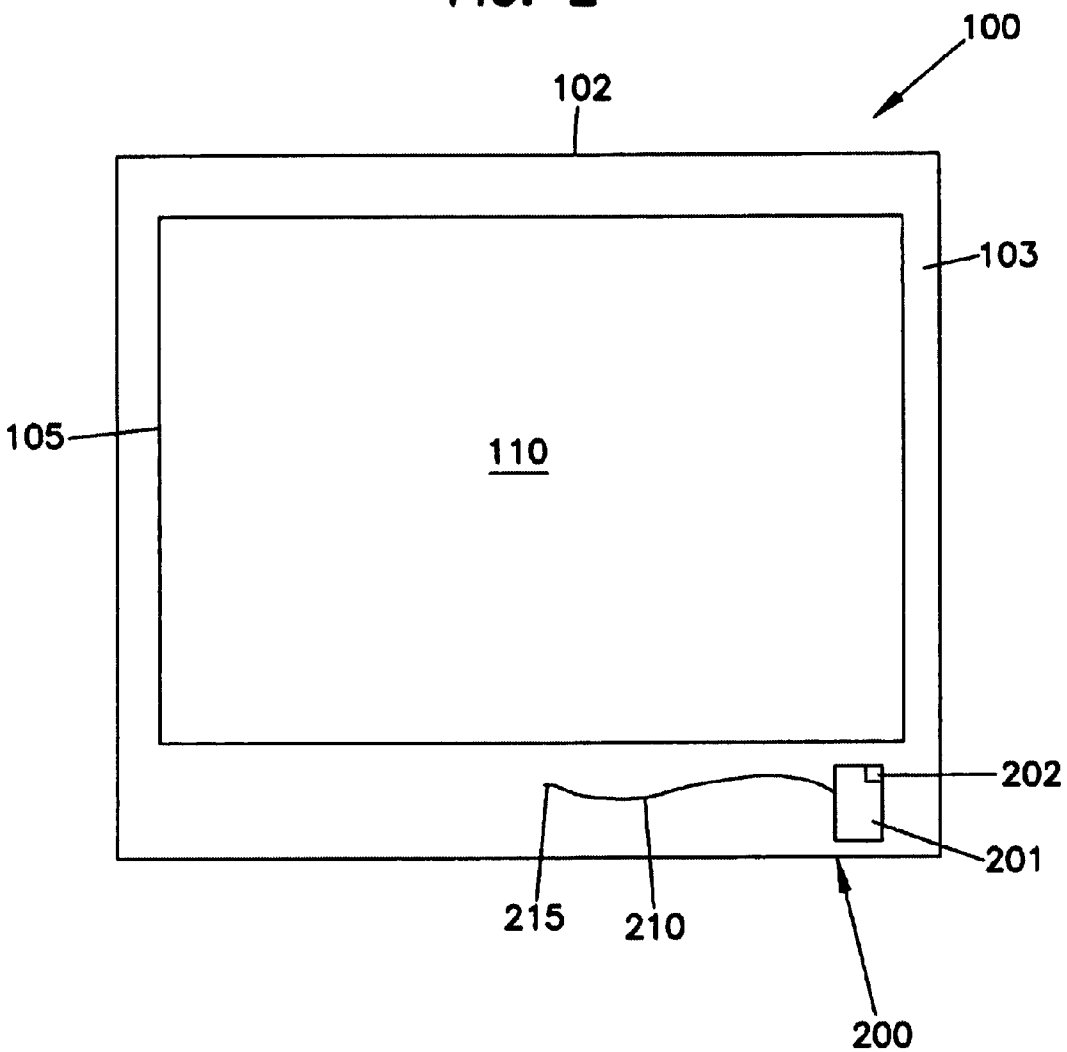
FIG. 2 is a cross-sectional view of the fireplace shown in FIG. 1 illustrating additional components comprising the first example embodiment of the proximity warning system.

In FIG. 2, the fireplace 100 is shown in cross-section taken through a front portion of the fireplace to show components located behind the front panel 103. A first example embodiment of a proximity warning system 200 is shown. As illustrated, the system 200 is coupled to the fireplace 100 in a position located behind the front panel 103. The position of the system 200 is a matter of design choice, and the system 200 may be mounted on or to any portion of the fireplace 100 or surrounding structure, preferably out of sight of users of the fireplace 100.

The system 200 includes a main module 201, as well as an alerting device 202 described in more detail below. The system 200 also includes a wire 210, with an end 215, which is electrically coupled to a sensor 301 including a plate 310 mounted or otherwise coupled to a portion 155 of the grill 150, a portion of which is illustrated in FIG. 3.

Figure 3:
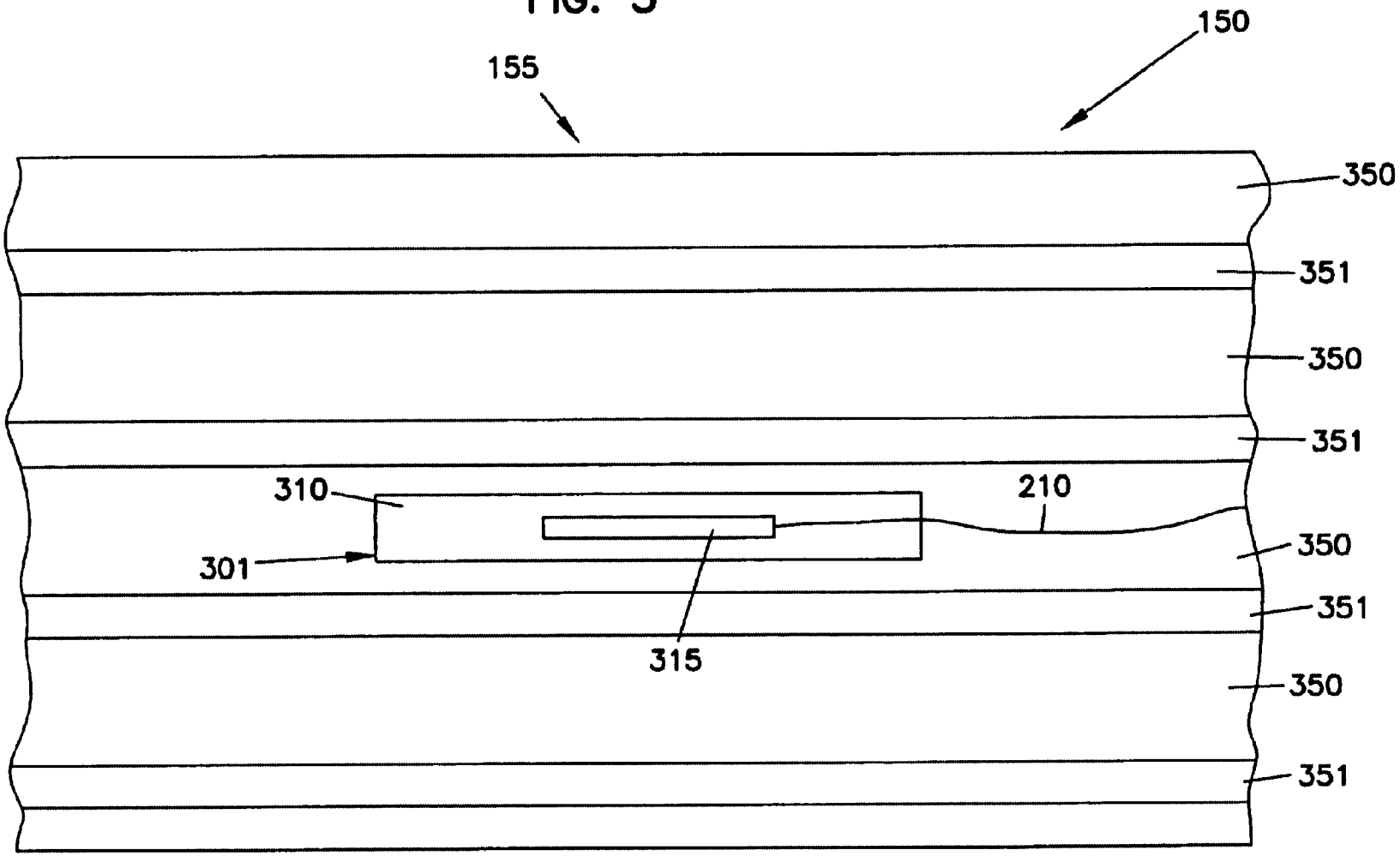
FIG. 3 is a front view of a portion of a grill of the fireplace shown in FIG. 1 illustrating an example plate including a conductive area used as part of the first example embodiment of the proximity warning system.

The portion 155 of the grill 150 shown in FIG. 3, which includes air slots 351 formed between adjacent slats 350 to allow air to flow through the grill 150, includes the plate 310 coupled to one of the slats 350 of the grill 150. The plate 310 includes a conductive area 315 that is electrically coupled to the main module 201 of system 200 through the wire 210.

The conductive area 315, which is preferably electrically isolated from the fireplace 100, may be made of any material that conducts electricity. The conductive area 315 may function in a manner similar to a capacitor. When an object approaches the conductive area 315, the capacitance may vary, as described below.

The sensor 301 is illustrated as being attached to the grill 150 in the example embodiment shown. However, the sensor 301 may also be coupled to any other exposed surface of the fireplace. For example, if the fireplace is a multi-sided unit, the sensor 301 may be coupled to any of the plurality of exposed surfaces of the multi-sided unit.

The proximity warning system 200 configured in this manner may function to monitor a defined zone proximate the fireplace 100 and generate an alarm when an object enters the defined zone. The example system 200 uses capacitance to monitor the defined zone.

Figure 4:
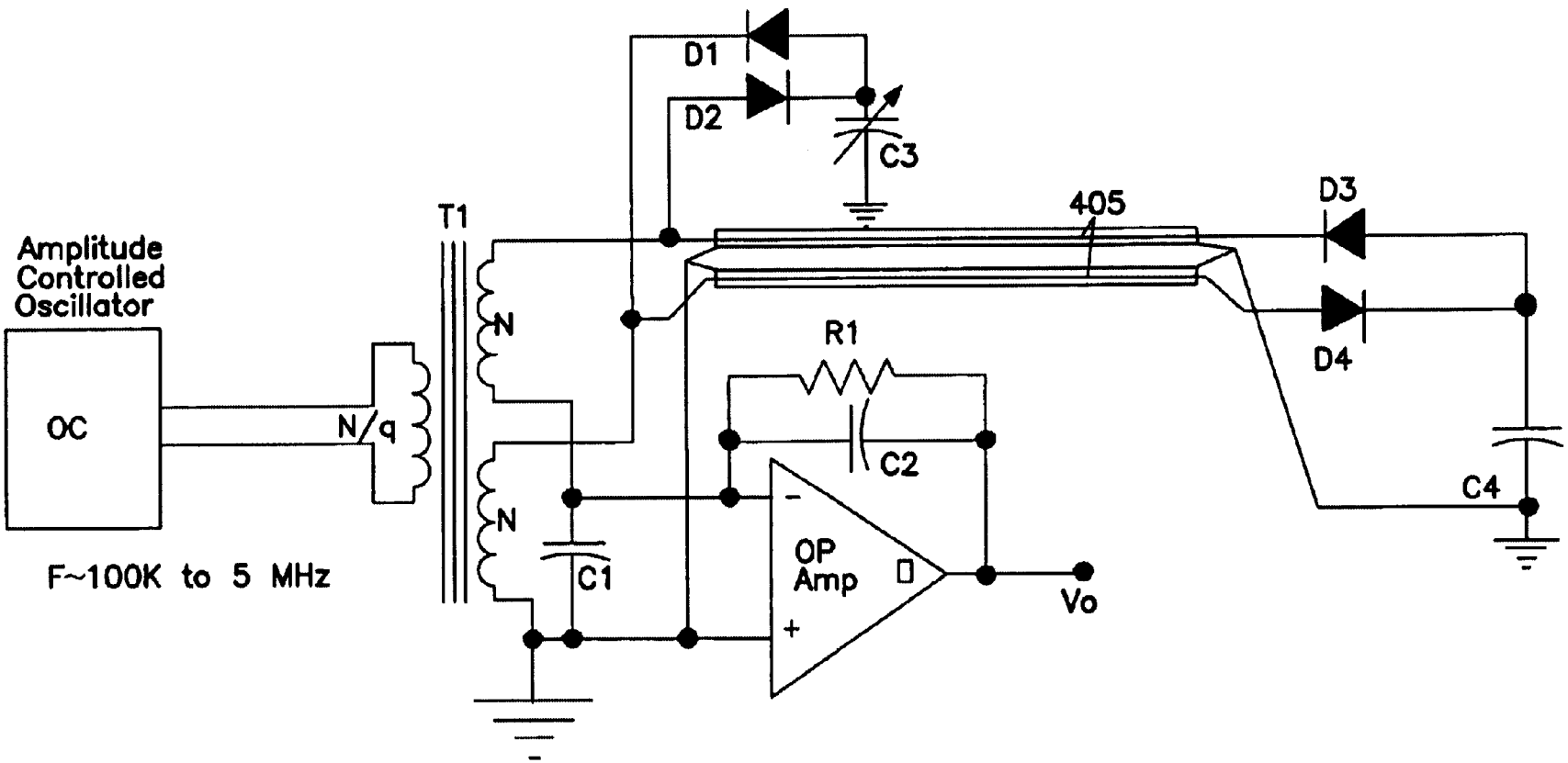
FIG. 4 is a schematic view of example electrical components that may be used to construct the first example embodiment of the proximity warning system of FIG. 1.

A schematic of the electrical components included in the system 200 is shown in FIG. 4. An oscillator OC is used to produce a relatively constant amplitude sine wave with a frequency preferably between 100 KHz to 5 MHz. Other frequencies may be used, and the frequency may be varied to vary the sensitivity of the system 200. A transformer T1 produces two isolated, equal outputs that may be higher than the input. Shielded cables 405 carry the sine wave out to what is labeled as a capacitor C4. The capacitor C4 represents the capacitance to be measured and comprises the conductive area 315 illustrated in FIG. 3. The capacitor C4 is charged positively through diode D4 and negatively through diode D3. Back at the other end of the cables, diodes D1 and D2 similarly charge a capacitor C3.

The charging current for C3 is of opposite polarity from C4, so the Net Current sensed by an operational amplifier Op Amp at the other end of the transformer winding of transformer T1 is proportional to the difference between the two capacitors C3 and C4. A voltage $V_o$ produced at the output of the Op Amp can be calculated as follows in Equation 1.

$$V_o = \text{Net Current} \times R1 \quad (1)$$

During calibration of the system, the capacitor C3 is adjusted until $V_o$ is equal to approximately 0 volts when no object is near the plate 310 forming the capacitor C4. The output of the Op Amp is coupled to an alerting device, such as the alerting device 202.

The warning system 200 can operate as follows. When an object approaches the conductive area 315 on the plate 310 forming capacitor C4, the capacitance fluctuates, thereby altering the current provided to the positive terminal of the Op Amp. Because the Net Current provided to the Op Amp has changed, $V_o$ is increased according to Equation 1. As $V_o$ increases, the voltage provided to the alerting device 202 coupled to the Op Amp increases and causes the alerting device to produce an alarm.

In this manner, an alarm is produced when an object approaches the capacitor C4 representing the plate 310. By placing the plate 310 on or near an exposed portion of the fireplace 100, a warning system can be created to provide an alarm whenever an object approaches the fireplace 100.

The output $V_o$ of the Op Amp can be coupled to various alerting devices, such as, for example, the alerting device 202. Example alerting devices include a speaker that can be used to produce an audible alarm, or a light that can be used to produce a visual alarm. If a visual alarm is desired, the light may be mounted to a front surface, such as the front panel 103, of the fireplace 100. The alerting device may be implemented as part of the system 200 itself, or may be implemented as a separate component coupled to the system 200.

The alarm may be configured so that the alarm increases in intensity or frequency as the object approaches closer to the fireplace 100. For example, if the alarm is audible, the alarm could increase in volume. Alternatively, a clicking sound could increase in frequency as the object approaches. If the alarm is visual, the alarm could increase in brightness or frequency of oscillation.

The alarm can also include a voice chip that may emit a voice recording when activated. For example, the alarm may emit the following audible alert when activated: "Caution! The fireplace is hot! Please be careful." Other phrases are also possible.

The configuration of the various components illustrated in the schematic of FIG. 4 is provided by way of illustration only. Many variations and different combinations of electrical components may be used to create the desired system without departing from the scope of the invention.

Figure 5:
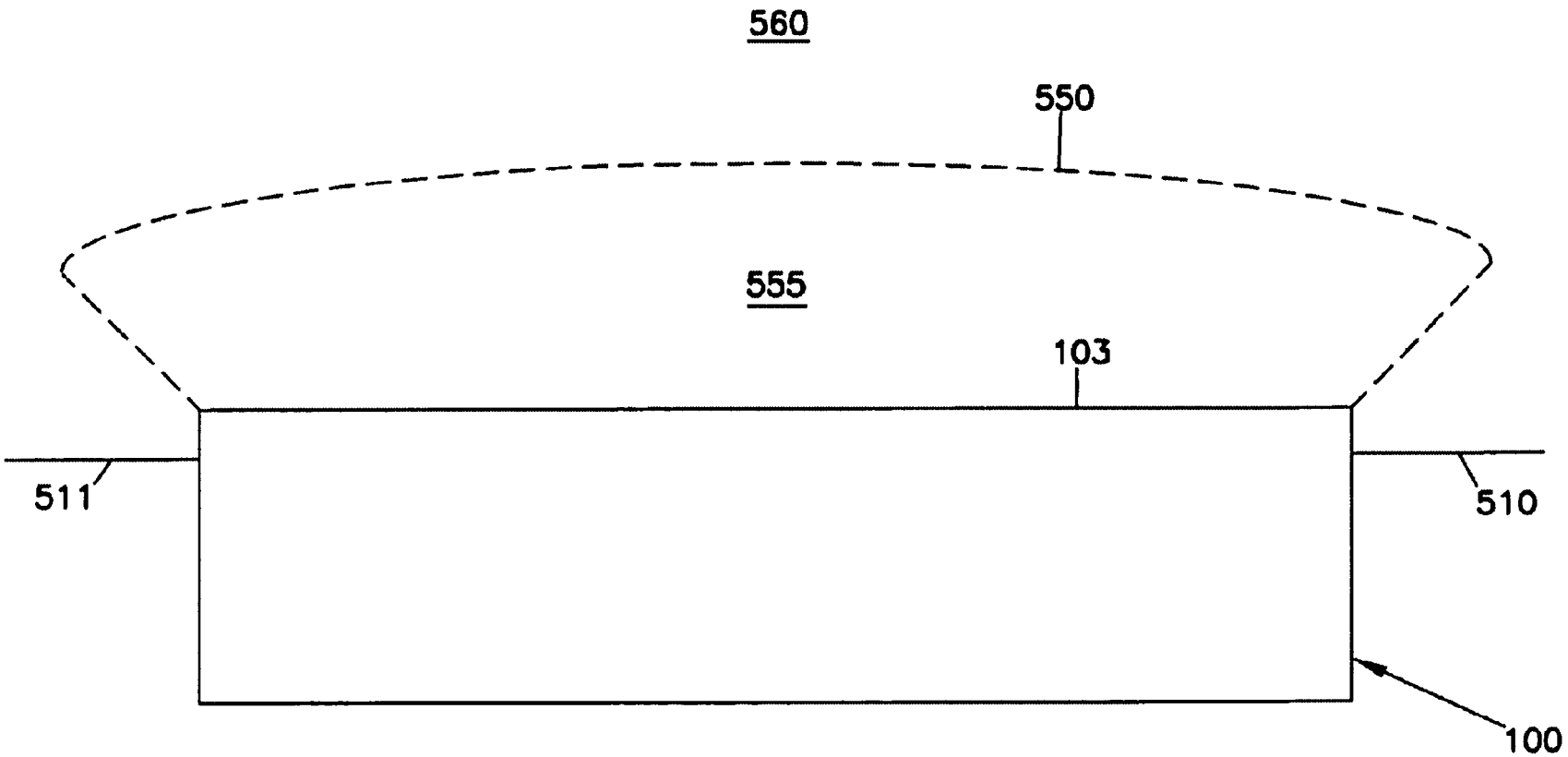
FIG. 5 is a top view of the example fireplace of FIG. 1 illustrating an example defined zone proximate the fireplace.

A top view of the fireplace 100 and an area 560 surrounding the fireplace 100 is shown in FIG. 5. The fireplace 100 is mounted to wall portions 510 and 511 extending on either side of the fireplace 100, and the fireplace 100 is illustrated with the front panel 103 facing the area 560. An outer boundary 500 (dashed line) represents the outer border of the proximity sensing provided by the warning system 200. A defined zone 555 enclosed between the outer boundary 500 and the fireplace 100 represents the area in which proximity sensing is provided by the warning system 200. When an object in the area 560 enters the defined zone 555, the warning system 200 generates an alarm. The defined zone 555 can be increased or decreased in size by, for example, adjusting the oscillator OC to change the frequency of the sine wave, as desired, to provide sufficient warning time. In an example embodiment, the defined zone 555 is sized so that the defined zone 555 extends approximately 1 foot from the front panel 103 of the fireplace 100. Other sizes are possible.

The warning system 200 can be configured to be turned on and off using a variety of methods. The system 200 can include a manual on-off switch, allowing a user to turn the system 200 on and off as desired. The system 200 can also be configured to automatically turn itself on and off. For example, the system 200 can include components, such as thermistor, to measure the temperature produced by the fireplace and turn on the system 200 when one or more portions of the fireplace reach a temperature which may be unsafe. Alternatively, if the fireplace is a gas fireplace, the system 200 can be turned on when the flames of the gas fireplace are started.

The warning system 200 can also be implemented with a plurality of sensors similar to sensor 301. Two or more sensors may be used to create a larger defined area to cover a larger area proximate a fireplace. A plurality of sensors may be coupled or placed adjacent to one or more exposed surfaces of a fireplace. This may be desirable, for example, if the fireplace is a multi-sided unit such as the fireplace disclosed in U.S. Pat. No. 5,076,254, the disclosure of which is hereby incorporated by reference. A multi-sided fireplace may include two or more exposed surfaces. Using two or more sensors coupled or placed adjacent to each exposed surface, a defined area can be created proximate each exposed surface. In this manner, multiple exposed surfaces can be protected using the proximity warning system. The plurality of sensors may each be coupled to the same main module, or alternatively, may be coupled to two or more main modules.

II. Second Example Embodiment

Figure 6:
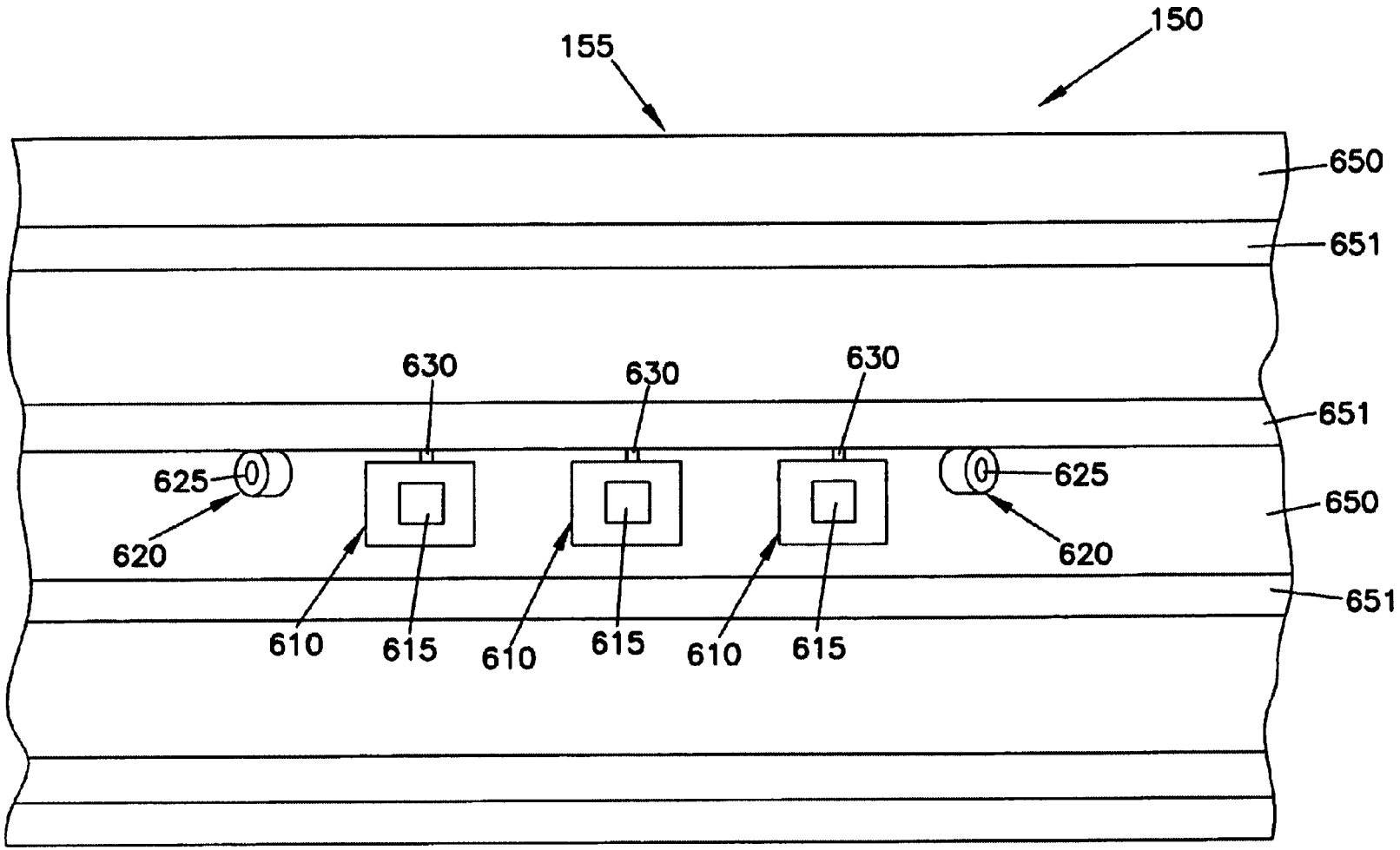
FIG. 6 is a front view of a portion of a grill of a fireplace illustrating a second example embodiment of a proximity warning system made in accordance with the present invention.

A example embodiment of another proximity warning system 600, shown in FIG. 6, is mounted to the portion 155 of the grate 150. In this example embodiment, air slots 650 are slightly larger than slats 651 of the grill 150, although grills of other sizes and configurations may also be used.

The system 600 generally includes two pulsed infrared light-emitting diodes (LEDs) 620 and three infrared receiver modules 610. Both the LEDs 620 and the receiver modules 610 are mounted to a slat 651. The receiver modules 610 are mounted using swivel rivets 630 so that the direction that the receiver modules 610 are facing may be changed, as described below.

The LEDs 620 each include a light-emitting surface 625 configured to emit a pulsed infrared signal. Each LED 620 may be any standard infrared LED, although preferably each LED may include a face configured to emit infrared light with angular uniformity. It may be desirable to use pulsed light because the receiver modules 610 differentiate the pulsed light signal from other sources of infrared light such as, for example, sunlight. The receiver modules 610 include a detecting window 615 with a photo diode for detecting any infrared signal reflected back at the receiver modules 610.

Figure 7:
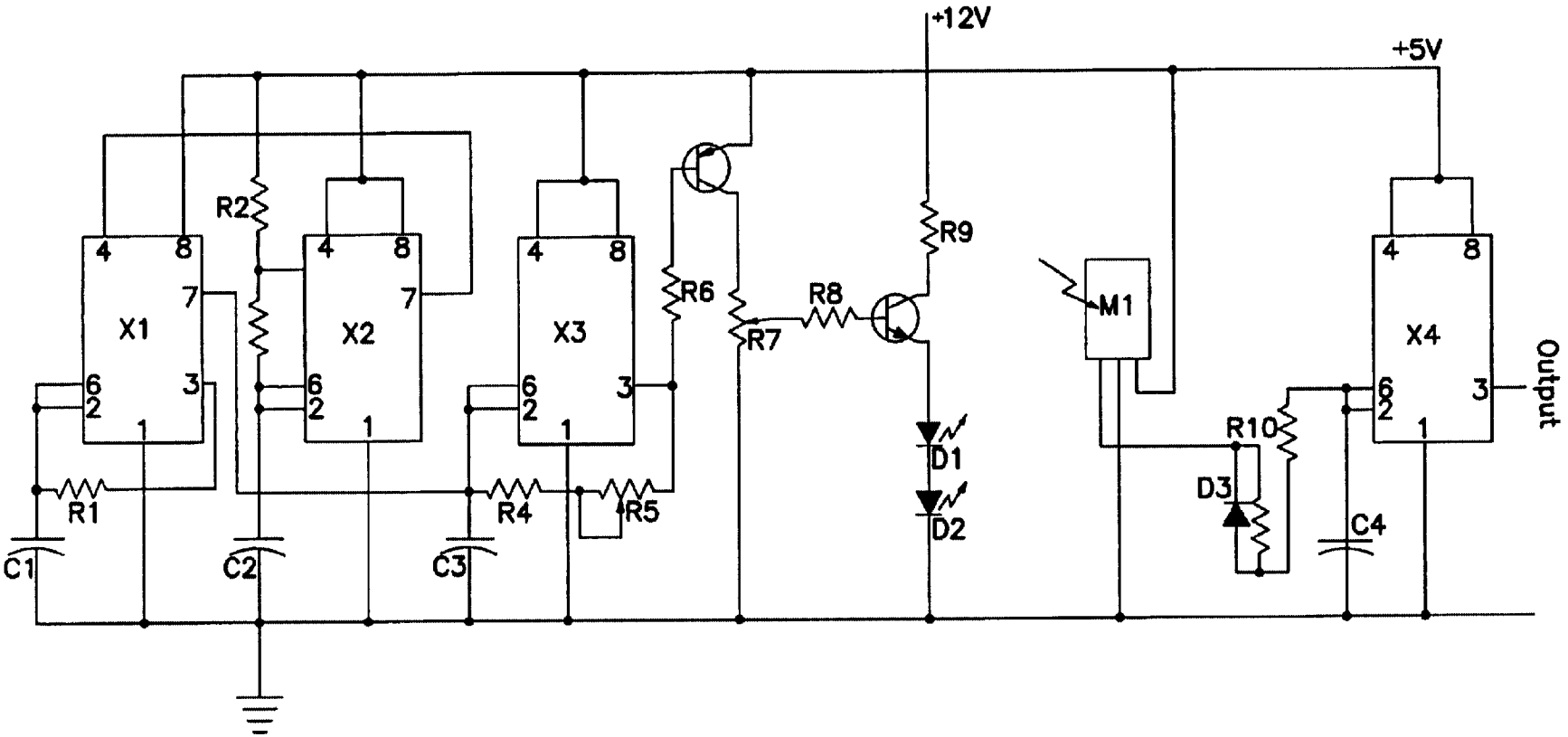
FIG. 7 is schematic view of example electrical components that may be used to construct the second example embodiment of the proximity warning system of FIG. 6.

An example circuit diagram for the warning system 600 is shown in FIG. 7. The circuit includes resistors R1–R11, capacitors C1–C4, timers X1–X4, infrared LEDs D1 and D2, diode D3, and receiver module M1. The resistors R5 and R7 are variable resistor potentiometers (POTs), which allow for a user to configure the strength of the output of the infrared LEDs and thereby configure the sensitivity of the warning system 600.

The timers X1–X4 may be, in one example embodiment, LMC555 CMOS timers from National Semiconductor of Santa Clara, California. Timer X3 may produce a signal of approximately 30 kHz to drive the LEDs D1 and D2. Timer X1 may produce a signal of approximately 1 kHz to oscillate the LEDs D1 and D2 on and off to create the pulsed infrared signals. Timer X2 may produce a signal to periodically (e.g., every 90 msecs) turn off the LEDs D1 and D2 for a specified period.

The receiver module M1 may be, in one example embodiment, an IR Receiver Module for PCM Remote Control Systems, type TK1830, manufactured by Vishay Americas, Inc. of Shelton, Conn. Although only one receiver module M1 is shown in the circuit diagram, additional modules may be used. When the receiver module M1 detects an infrared signal, the module M1 activates the timer X4. The output of the timer X4 (pin 3) may be coupled to one or more of the alerting devices described above.

The warning system 600 may function as follows. Infrared light, in the form of pulsed signals, is emitted from the LEDs 620. The infrared light may reflect off of any surface of any object that enters a defined zone in front of the fireplace in which the warning system 600 is mounted. The receiver modules 610 are positioned to receive any pulsed infrared signal that is reflected back at the fireplace and to activate the alerting device. The receiver modules 610 may be swiveled, as desired, to configure the warning system 600.

More or fewer LEDs and receiver modules may be used. In addition, the placement of the LEDs and/or the receiver modules may be varied. For example, the LEDs 620 and the receiver modules 610 may be mounted to the grill 160, shown in FIG. 1, rather than the grill 150. Other placement is also possible.

III. Other Example Embodiments

Warning systems employing other approaches and methods other than capacitance and pulsed infrared light may also be used without departing from the scope of the invention. For example, systems employing one or more of the following approaches may be used: inductance, radar, ultrasound, radio frequencies (RF), and/or pulsed-light. This is not provided as an exhaustive list. Any system may be used so long as it is configured to monitor a defined zone proximate a fireplace and generate an alarm when an object enters the defined zone. Also, any combination of capatible systems described herein can be implemented.

The example proximity warning systems 200 and 600 described in accordance with the present invention may be utilized to enhance safety when using a fireplace. For example, it may be desirable to use the proximity warning system to monitor when small children, pets or other objects that are in danger of being burned approach a fireplace. By calibrating the size of the defined zone and method of alarming, an individual can be alerted and take remedial action before, for example, a small child gets close enough to a fireplace to touch the heated front surface. In this manner, the example proximity warning systems function to increase safety and decrease possible adverse incidents surrounding the use of a fireplace.

The present invention should not be considered limited to the particular examples or materials described above, but rather should be understood to cover all aspect of the invention as fairly set out in the attached claims. Various modifications, equivalent processes, as well as numerous structures to which the present invention may be applicable will be readily apparent to those of skill in the art to which the present invention is directed upon review of the instant specification.

What is claimed:

1. A proximity warning system for a fireplace, the system comprising:

a monitor module coupled to the fireplace, wherein the monitor module is configured to automatically turn on when the fireplace reaches a given temperature to sense when an object enters a defined zone proximate to the fireplace; and an alarm module coupled to the monitor module to generate an alarm when the monitor module senses that the object has entered the defined zone.

2. The system of claim 1, wherein the monitor module is configured to measure capacitance to sense when the object has entered the defined zone.

3. The system of claim 1, wherein the monitor module is configured to emit infrared light to sense when the object has entered the defined zone.

4. The system of claim 1, where the system includes a plurality of monitor modules coupled to the fireplace.

5. The system of claim 1, wherein the alarm module is configured to vary an intensity of the alarm depending on a distance within the defined zone between the object and the fireplace.

6. The system of claim 1, wherein the alarm is audible.

7. The system of claim 1, wherein the alarm is visual.

8. The system of claim 1, wherein the monitor module and the alarm module are implemented as a single module.

9. The system of claim 1, wherein a size of the defined zone can be varied.

10. A fireplace including a proximity warning system, the fireplace comprising:

an enclosure defining a combustion chamber and including at least one exposed surface;

a plate coupled to the at least one exposed surface, wherein the plate includes a conductive area forming a first capacitor;

a capacitance module, wherein the capacitance module is electrically coupled to the conductive area and includes a second capacitor that is tunable to match a capacitance of the first capacitor; and an alarm module electrically coupled to the capacitance module to generate an alarm when an object enters a defined zone proximate the fireplace and thereby cause the capacitance of the first capacitor to vary with respect to a capacitance of the second capacitor.

11. The fireplace of claim 10, wherein the fireplace includes a plurality of exposed surfaces and a plurality of plates coupled to the plurality of exposed surfaces.

12. The fireplace of claim 10, wherein the system is configured to automatically turn on when the fireplace reaches a given temperature.

13. The fireplace of claim 10, wherein the alarm is audible.

14. A method for warning when an object approaches a fireplace, the method comprising steps of:

providing a monitor module for monitoring when an object enters a defined zone proximate the fireplace;

providing an alarm module coupled to the monitor module for generating an alarm when the object centers the defined zone;

monitoring the defined zone, including:

matching a first capacitance with a second capacitance;

measuring when the first capacitance varies with respect to the second capacitance; and changing a voltage output based on variance in the first and second capacitance; and generating an alarm when the object enters the defined zone.

15. A method for warning when an object approaches a fireplace, the method comprising steps of:

providing a monitor module for monitoring when an object enters a defined zone proximate the fireplace;

providing an alarm module coupled to the monitor module for venerating an alarm when the object enters the defined zone;

turning on the monitor module automatically when the fireplace reaches a given temperature;

monitoring the defined zone; and generating an alarm when the object enters the defined zone.

16. The method of claim 15, wherein the monitoring step includes steps of:

transmitting infrared light; and receiving infrared light that is reflected toward the fireplace.

17. The method of claim 15, further comprising a step of varying a size of the defined zone.

18. The method of claim 15, wherein the generating step comprises a step of sounding an audible alarm.

19. The method of claim 15 wherein the generating steo comprises a step of imstigatind a visual alarm.

* * * * *